US006164228A

United States Patent [19]

Lin et al.

[11] Patent Number: 6,164,228

[45] Date of Patent: Dec. 26, 2000

[54] PROCESS AND CONFIGURATION OF PROTRUDING EMBROIDERY

[76] Inventors: Chien-Lu Lin, 28, Tunnel 239, Chiu Ju 1 Road; Ming-Chin Chou, 27, Tunnel 239, Chiu Ju 1 Road, both of Kaohsiung, Taiwan

[21] Appl. No.: 09/382,312

[22] Filed: Aug. 24, 1999

[51] Int. Cl.[7] ..... D05C 17/00

[52] U.S. Cl. ..... 112/475.22; 112/439

[58] Field of Search ..... 112/475.22, 439, 112/475.18, 98, 99, 420, 421, 429; 2/244; 156/90, 91, 93

[56] References Cited

U.S. PATENT DOCUMENTS

| | | | |
|---|---|---|---|
| 4,140,563 | 2/1979 | Sernaker | 112/475.18 X |
| 5,241,919 | 9/1993 | Lagreca | 112/439 X |
| 5,832,854 | 11/1998 | Lin et al. | 112/475.22 |
| 5,947,044 | 9/1999 | Lin et al. | 112/475.22 |

FOREIGN PATENT DOCUMENTS

| | | | |
|---|---|---|---|
| 2277869 | 11/1990 | Japan | 112/439 |

*Primary Examiner*—Ismael Izaguirre

*Attorney, Agent, or Firm*—Raymond Y. Chan; David and Raymond

[57] ABSTRACT

A protruding embroidery process which is specially adapted for mass production includes the following steps. Lay and affix a filler by adhering or sewing on an embroidering background element, in which the filler has an even thickness and a size larger than a controur size of a desired embroidering figure for covering a figure portion on the embroidering background elemnet where the desired embroidering figure is required to embroider. Entirely wrap up an embroidering portion of the filler and the embroidering background element with a plurality of sewing threads until the whole embroidering portion is entirely covered and wrapped up by the sewing threads. A size of the embroidering portion smaller than the desired embroidering figure is required to embroider. Fully cut off and remover a leftover portion from the embroidering portion. The leftover portion is an outer portion of the filler surrounding the embroidering portion. Entirely wrap up a side periphery of the embroidering portion of the filler and the embroidering background element with a plurality of sewing threads until the whole embroidering portion is entirely covered and wrapped up by the sewing threads, and thus a size of the embroidering portion which is required to embroider is same as the desired embroidering figure.

13 Claims, 3 Drawing Sheets

PROCESS AND CONFIGURATION OF PROTRUDING EMBROIDERY

FIELD OF THE INVENTION

The present invention relates to embroidery, and more particularly to a process and configuration of protruding embroidery which is adequate for mass production.

BACKGROUND OF THE INVENTION

A conventional method of embroidery an embroidery with protruding figures is to provide a plurality of overlapped layers of thread. Embroidering machine embroiders a small draft as a bottom layer on a cloth or silk background element which can be processed to a table cover, floss silk, shoe, or a baseball cap. The background element is gradually embroidered layer by layer until a predetermined thickness of the thread layers is achieved so as to provide a protruding figure on the background element.

However, the conventional embroidering method and embroidery configurations have the following drawbacks:

(1) It can only produce a slightly protruded embroidery which is gradually raised from the edge of the embroidered figure to form a thickness of not more than 2.5 mm (2 mm to 2.5 mm) at the central portion.

(2) Since the protruded embroidery is formed with many layers of thread, it utilizes a great amount of threads and increases the cost and embroidering time. Moreover, the quality achieved is not smooth and solid enough.

(3) Many needle holes are formed on the background element that will weaken the duration and reduce the strength of the embroidery product.

Another embroidery method is a manual operation method. Craftsman cuts a hard plate, such polyvinyl chloride, according to the contour of a desired embroidering figure as a filler. The filler is placed and affixed in a position on the embroidery background element. Craftsman then wraps up the filler by sewing with thread manually. Protruding embroidery figures are thus formed on the background element.

This handwork embroidery can generally achieve flat protruding embroidery figures with even thickness and precipitous edges. The maximum thickness of the protruding embroidery can be 4 mm to 4.5 mm. However, when the figure to be embroidered has a long contour side edge, the long side edge of the filler is difficult to be entirely wrapped up by the sewing thread. To some small or thin portion of the embroidery figure, it is difficult to affix the small or thin fillers in position before processing the embroidering work. Elegant embroidery can only be obtained by precision work of experienced craftsmen who have to spend a lot of time on superior embroidering handwork. Thus, the conventional handwork embroidery method is only adequate for articles of handicraft art where identical embroidery figures on clothing and baseball caps, identical embroidery figures are required. In view of utilization, the aforesaid handwork embroidery does not conform to the industry benefit.

SUMMARY OF THE INVENTION

It is thus a main object of the present invention to provide a process and configuration of protruding embroidery which is adequate for mass producing identical protruding embroidery products.

A further object of the present invention is to provide a process and configuration of protruding embroidery which can be utilized to embroider an embroidery figure with tiny portions.

Another object of the present invention is to provide a process and configuration of protruding embroidery which can effectively clear all the remnants along the side edges of the filler and produced a protruding embroidery that is near perfection.

Accordingly, the present invention provides a protruding embroidery process which comprises the following steps:

(a) lay and affix a filler by adhering or sewing on an embroidering background element, in which the filler has an even thickness and a size larger than a contour size of a desired embroidering figure for covering a figure portion on the embroidering background element when the desired embroidering figure is required to embroider;

(b) entirely wrap up an embroidering portion of the filler and the embroidering background element with a plurality of sewing threads until the whole embroidering portion, including a predetermined number of side edges thereof, is entirely covered and wrapped up by the sewing threads. A size of the embroidering portion—smaller, than the desired embroidering figure, is required to embroider;

(c) Fully cut off and remove a leftover portion, which is an outer portion of the filler surrounding the embroidering portion, from the embroidering portion; and (d) entirely wrap up a side periphery of the embroidering portion of the filler and the embroidering background element with a plurality of sewing threads until the whole embroidering portion is entirely covered and wrapped up by the sewing threads, and thus, a size of the embroidering portion the same as the desired embroidering figure, is required to embroider.

By means of the above disclosed process, a configuration of protruding embroidery is manufactured, which comprises an embroidering background element having a figure portion; a filler which has a predetermined embroidering figure and a thickness not more than 4.5 mm and is attached on the background element to cover the figure portion of the embroidering background element; and a plurality of sewing threads enwrapping around the embroidering figure of the filler and the figure portion of the embroidering background element, wherein the entire filler including a predetermined number of side edges thereof is entirely covered and wrapped up the sewing threads to form a protruding embroidery.

DETAIL DESCRIPTION OF THE PREFERRED EMBODIMENT

Figure 1:
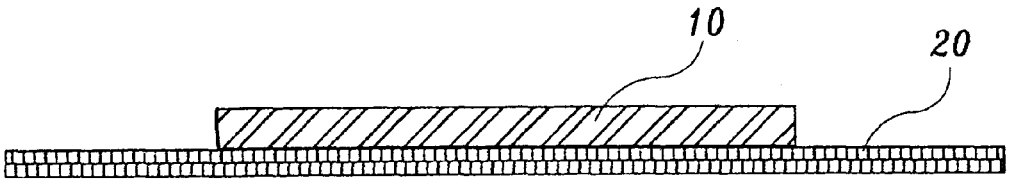
FIG. 1 is a sectional end view of a preferred embodiment of in accordance with the present invention, illustrating a filler laid on an embroidering background element.

Referring to FIGS. 1 to 5, a protruding embroidery process according to a preferred embodiment of the present invention, which comprises the following steps:

(a) As shown in FIG. 1, lay and affix a filler 10 by adhering or sewing on an embroidering background element 20, in which the filler 10 has an even thickness of not more than 4.5 mm and a size larger than a contour size of a desired embroidering figure for covering a figure portion on the embroidering background element 20 where the desired embroidering figure is required to embroider thereon.

Figure 2:
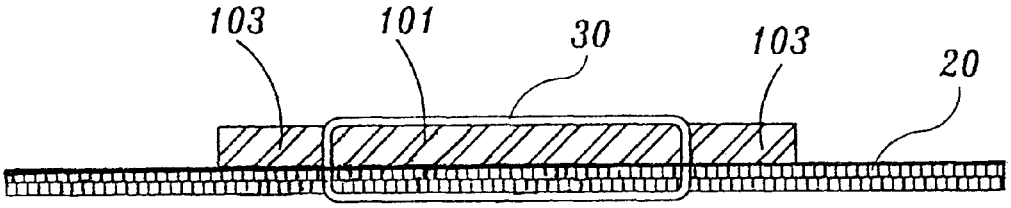
FIG. 2 s sectional end view of the above preferred embodiment in accordance with the Present invention, illustrating the embroidering of the filler and the embroidering Background element.

(b) As shown in FIG. 2, entirely wrap up an embroidering portion 103 of the filler 10 and the embroidering background element 20 with a plurality of sewing threads 30 until the whole embroidering portion 101, including a predetermined number of side edges thereof, is entirely covered and wrapped up by the sewing threads 30. A size of the embroidering portion 101 smaller than, the desired embroidering figure, is required to embroider.

Figure 3:
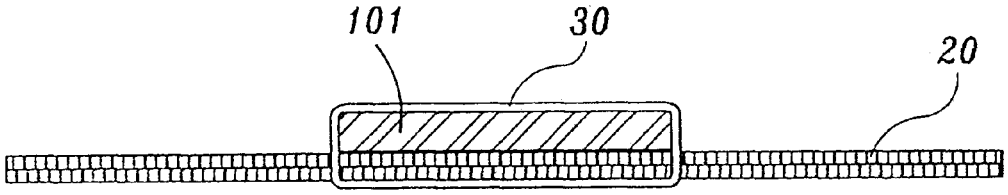
FIG. 3 is sectional end view of the above preferred embodiment in accordance with the Present invention, illustrating the removing leftover from the side periphery of the protruding embroidery.

(c) As shown in FIG. 3, fully cut off and remove a leftover portion 103, which is an outer portion of the filler 10 surrounding the embroidering portion 101, from the embroidering portion 101.

Figure 4:
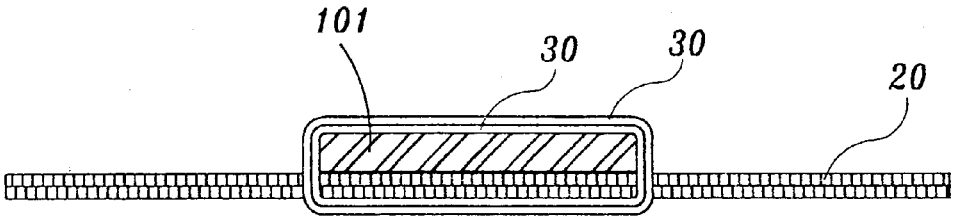
FIG. 4 is a sectional end view of a protruding embroidery manufactured by means of the process of the above preferred embodiment of the present invention.
Figure 5:
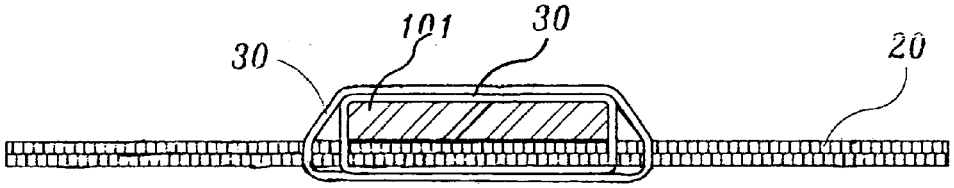
FIG. 5 is a sectional end view of a protruding embroidery manufactured by means of the process of the above preferred embodiment of the present invention.

(d) As shown in FIG. 4 and FIG. 5, entirely wrap up a side periphery of the embroidering portion 101 of the filler 10 and the embroidering background element 20 with a plurality of sewing threads 30 until the whole embroidering portion 101 is entirely covered and wrapped up by the sewing threads, and thus, a size of the embroidering portion 101 the, same as the desired embroidering figure, is required to embroider.

In accordance with the above preferred embodiment the protruding embroidery process is preferred to proceed with a numerical control (NC) embroidery machine as of conventional. The conventional NC embroidery machine generally comprises a plurality of lined up embroidery units for processing identical embroideries on several embroidering background elements respectively at one time. Each embroidery unit has an operating table surface and several needles positioned perpendicularly to the operating table surface. The needles are all threaded with threads in difference colors respectively and are preferred to be made of wear-resisting steel.

The contour of a figure which is required to embroider on the both or silk embroidering background element is input into the computer of the embroidery machine for formatting, so that the paths and the number of the needle perforating during embroidering will be calculated as numerical data. Such numerical data will be transmitted to the embroidery machine to operate the embroidering of general flat surface embroidering. Actually, the movement of the operating table in longitudinal and transversal directions.

In step (a), as shown in FIG. 1, the cloth or silk embroidering background elements are placed in position on the embroidery table surfaces of the embroidery units of the embroidery machine respectively. The filler 10 is made a kind of resilient material that would shrink when it is heated to a predetermined temperature higher than room temperature and has a low friction of efficient. The filler 10 is laid on the embroidering background element 20 in a position desired to proceed protruding embroidery figure. The filler 10 can be adhered by tape or sewed to affix on the embroidering background element 20 (just few stiches to make sure the filler 10 is affixed in position).

Figure 6:
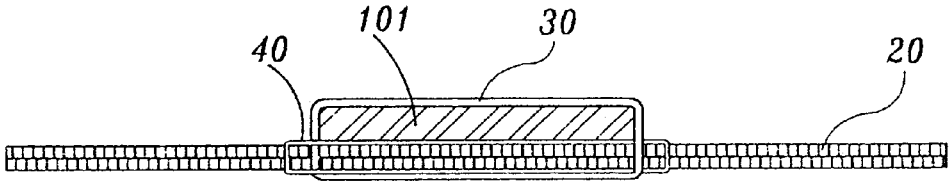
FIG. 6 is a sectional end view of a protruding embroidery with a lining embroidery underneath in accordance with the present invention.

In certain circumstances, a lining embroidery is needed to line underneath the protruding embroidery. Referring to FIG. 6, the aforesaid steps (a) to (d) are processed after a lining step of sewing a flat embroidery on the embroidering background element 20 to form a lining embroidery 40 which has a size larger than the protruding embroidery. The filler 10 is laid and affixed on the lining embroidery 40. Then the step (a) to (d) are processed.

In fact, the leftover portion 103 of the filler 10 is torn off from the wrapped embroidering portion 101 of the filler 10 after step (c). Some leftover filler remnants will be remained between the sewing threads 30 which wraps the side edges of the filler 10. It is difficult to clear all these remnants. Even the craftsmen cut the remnants carefully and finely, only the larger remnants can be cleared and generally about eighty percent of the tiny remnants will be left over. Such coarse side edges may seriously reduce the quality of the protruding embroidery. The above defects cannot be solved even if slender needles are used for embroidering. It is because the slender needles may also damage and cut off the previous wrapped sewing threads 30 during perforating the filler 10.

However, the embroidery process of the present invention can successfully remove all leftover filler remnants and produce a protruding embroidery that is near perfection, and thus the production process not only becomes more time efficient, but also is more economically competitive.

Figure 7:
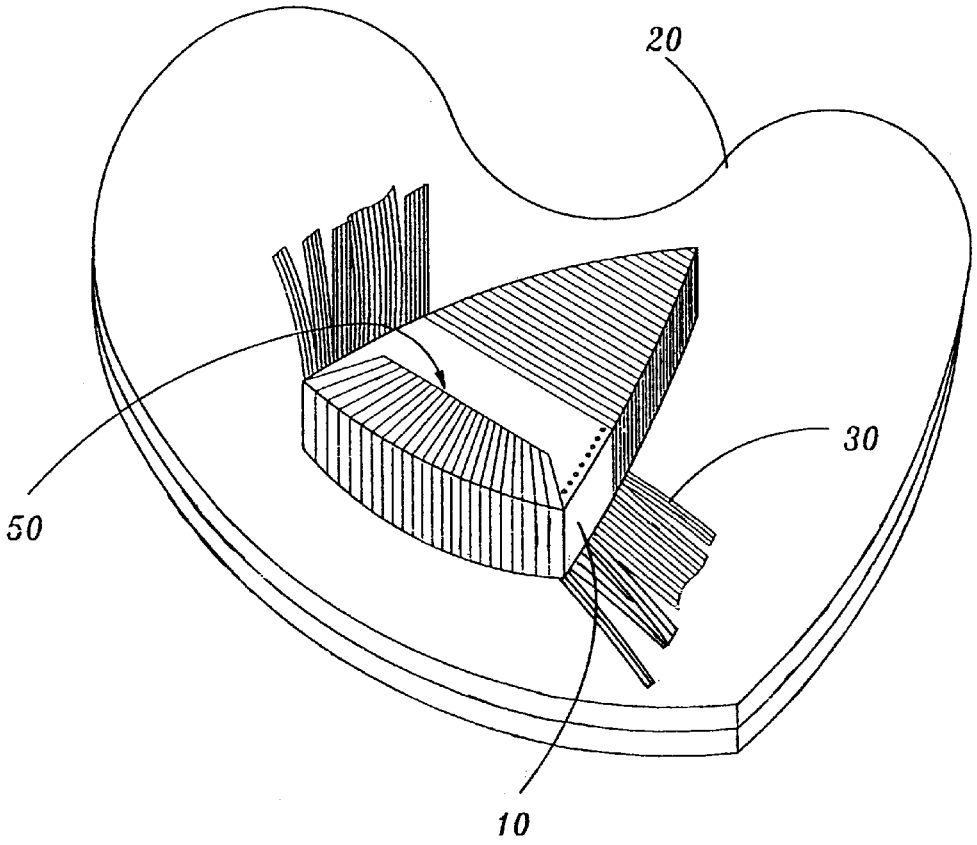
FIG. 7 is a perspective view of a protruding embroidery having portion of the wrapped Threads be cut to illustrate a semi-wrapping embroidery in accordance with the present invention.

It is worth to disclose that the collapse of the corners or edges of the protruding embroidery figure, which may frequently happen in the conventional protruding embroidery, can be prevented when the protruding embroidery process of the present invention is utilized. Referring to FIG. 7, a semi-wrapping embroidering procedure is processed before the regular embroidery step (b). Such semi-wrapping embroidery 50 is processed by sewing from the side edge of the corner of the edge of the desired embroidery figure to an inner portion of the filler 10. Thus, the path of the semi-wrapped embroidery is perpendicularly to the path of the regular protruding embroidery in step (b).

It is obvious for someone skilled in art to cut the filler to desired figure first and then to lay and affix the finisged filler on the embroidering background element for embroidering with the aforesaid embroidery machine. However, an embroidery figure comprises generally more than one constituent part, such as the "Adidas" logo totally consisting of seven constituent parts. Thus, it consumes too much time in filler affixing operation. Such affixing time will be several times more than the embroidering time. Furthermore, a craftsman is generally required to operate fifteen to twenty embroidery units at the same time for mass production, so that this obvious process does not conform to the industry benefit for utilization.

By means of the above process disclosed in the above preferred embodiment, a configuration of protruding embroidery is produced, as shown in FIGS. 3 and 5, which comprises:

An embroidering background element 20 having a figure portion;

A filler 10 which has a predetermined embroidering figure being attached on the embroidering background element 20 to cover the figure portion of the embroidering background element 20; and A plurality of sewing threads 30 twice enwrapping around the embroidering figure of the filler 10 and the figure portion of the embroidering background element 20, wherein the entire filler 10 including a predetermined number of side edges thereof is entirely covered and wrapped up the sewing threads 30 to form a protruding embroidery.

Moreover, as shown in FIG. 6, a lining embroidery 40 which has a size larger than the protruding embroidery can be provided between the filler 10 and the embroidering background element 20; Also, as shown in FIG. 7, a semi-wrapping embroidery 50, can be provided at a side edge of the filler 10 by sewing from the side edge to an inner portion of the filler 10 with the sewing threads 30. Besides, the filler 10 is preferable to have an even thickness of not more than 4.5 mm and is attached to the embroidering background element 20 by adhering with tape or sewing with a few stiches.

What is claimed is:

1. A protruding embroidery process, comprising the steps of:

(a) laying and affixing a filler on an embroidering background element, in which said filler has an even thickness and a size larger than a contour size of a desired embroidering figure for covering a figure portion on said embroidering background element where a desired embroidering figure is required to embroider;

(b) entirely wrapping up an embroidering portion of said filler and said embroidering background element with sewing threads until the whole embroidering portion, including a predetermined number of side edges, thereof, is entirely covered and wrapped up by said sewing threads, wherein a size of said embroidering portion smaller than said desired embroidering figure is required to embroider;

(c) cutting off and removing a leftover portion, which is an outer portion of said filler surrounding said embroidering portion, from said embroidering portion; and (d) entirely wrapping up a side periphery of said embroidering portion of said filler and said embroidering background element with said sewing threads until said whole embroidering portion is entirely covered and wrapped up by said sewing threads, wherein said size of said embroidering portion to be required to embroider is same as said desired embroidering figure.

2. A protruding embroidery process, as recited in claim 1, wherein said filler has an even thickness of not more than 4.5 mm.

3. A protruding embroidery process, as recited in claim 1, before step (a), furthering comprising an additional step of sewing a flat embroidery on said embroidering background element to form a lining embroidery which has a size larger than said protruding embroidery, wherein said filler is laid and affixed on said lining embroidery.

4. A protruding embroidery process, as recited in claim 1, in step (b), further comprising a step of semi-wrapping at least a side edge of said desired embroidery figure by sewing with said sewing threads to form a semi-wrapping embroidery.

5. A protruding embroidery process, as recited in claim 2, in step (b), further comprising a step of semi-wrapping at least a side edge of said desired embroidery figure by sewing with said sewing threads to form a semi-wrapping embroidery.

6. A protruding embroidery process, as recited in claim 3, in step (b), further comprising a step of semi-wrapping at least a side edge of said desired embroidery figure by sewing with said sewing threads to form a semi-wrapping embroidery.

7. A protruding embroidery process, as recited in claim 1, wherein, in step (a), said filler is adhered by tape on said embroidering background element.

8. A protruding embroidery process, as recited in claim 1, wherein, in step (a), said filler is sewed by a few stiches to affix on said embroidering background element.

9. A protruding embroidery, comprising:

an embroidering background element having a figure portion;

a filler having a predetermined embroidering figure and being attached on said background element to cover said figure portion of said embroidering background element; and a plurality of sewing threads twice enwrapping around said embroidering figure of said filler and said figure portion of said embroidering background element, wherein said entire filler including a predetermined number of side edges thereof is entirely covered and wrapped up said sewing threads to form said protruding embroidery.

10. A protruding embroidery, as recited in claim 9, wherein said filler has an even thickness of not more than 4.5 mm.

11. A protruding embroidery, as recited in claim 10, further comprising a lining embroidery, which has a size larger than said protruding embroidery, providing between said filler and said embroidering background element.

12. A protruding embroidery, as recited in claim 10, wherein a semi-wrapping embroidery is provided at a side edge of said filler by sewing from said side edge to an inner portion of said filler with said sewing threads.

13. A protruding embroidery, as recited in claim 11, wherein a semi-wrapping embroidery is provided at a side edge of said filler by sewing from said side edge to an inner portion of said filler with said sewing threads.

* * * * *